US006273647B1

(12) United States Patent
Vande Sande et al.

(10) Patent No.: US 6,273,647 B1
(45) Date of Patent: Aug. 14, 2001

(54) PRESSURE DISCHARGE RAILWAY HOPPER CAR

(75) Inventors: Jerry W. Vande Sande, Colleyville; Stephen W. Smith, Dallas, both of TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/294,728

(22) Filed: Apr. 19, 1999

Related U.S. Application Data

(60) Provisional application No. 60/082,702, filed on Apr. 22, 1998, and provisional application No. 60/082,701, filed on Apr. 22, 1998.

(51) Int. Cl.[7] ..... B60P 1/60

(52) U.S. Cl. ..... 406/41; 52/197; 53/151; 105/248; 406/145

(58) Field of Search ..... 52/197; 53/151; 105/248; 406/41, 145

(56) References Cited

U.S. PATENT DOCUMENTS

| | | | | |
|---|---|---|---|---|
| 1,422,133 | * | 7/1922 | Robider . | |
| 2,089,347 | * | 8/1937 | Dondlinger . | |
| 2,274,708 | | 3/1942 | Kennedy | 302/53 |
| 2,950,143 | | 8/1960 | Koranda et al. | 302/52 |

(List continued on next page.)

FOREIGN PATENT DOCUMENTS

| | | | |
|---|---|---|---|
| 844874 | 6/1970 | (CA) | 105/123 |
| 1015007 | 8/1977 | (CA) | 302/33 |
| 1101021 | 5/1981 | (CA) | 302/17 |
| 1149230 | 7/1983 | (CA) | 105/123 |
| 1156513 | 11/1983 | (CA) | 105/123 |
| 1165182 | 4/1984 | (CA) | 105/123 |
| 1174114 | 9/1984 | (CA) | 105/122 |
| 3402895A1 | 8/1984 | (DE) | B65G/67/24 |

OTHER PUBLICATIONS

North American Car Corp. brochure, "The Unique Car, A Totally Flexible Distribution System for Dry Flowable Products." No date.

Trinity Industries, Inc. Operating brochure, "Power Flow" (PF/RSB–3M–6/88), 1988.

Solimar brochure, "Pneumatic Systems for Dry Bulk Trailers, Railway Cars and Storage Silos" No date.

ACF Shippers Car Line Div., Operating & Service Manual, "Center Flow Pressureaide, Pressure Differential Car." 1962 ACF Industries, Inc., 1982.

GATX Operating Manual, "Power–Flo" No date.

AAA Manual of Standards and Recommended Practices, Section C, Car Construction Fundamentals and Details, 1979.

(List continued on next page.)

*Primary Examiner*—Robert P. Olszewski
*Assistant Examiner*—Richard Ridley
(74) *Attorney, Agent, or Firm*—Baker Botts L.L.P.

(57) ABSTRACT

A pressure discharge railway hopper car includes a car body having a plurality of hoppers arranged in adjacent relation longitudinally, each opening at the bottom end to an aerator tub assembly. Each aerator tub assembly has two aerator units, one on each side laterally of the longitudinal centerline of the car body, defined by downwardly convergent inclined walls. An outlet from each aerator unit is connected to a product discharge conduit that leads substantially horizontally and laterally toward the centerline of the car body to a generally L-shaped discharge pipe. Each discharge pipe may include a longitudinal leg that runs between the two sections along the car centerline and a lateral leg extending transversely to the centerline to an outlet end laterally outwardly of the aerator tub assembly, where it is connected to a main discharge pipe.

20 Claims, 7 Drawing Sheets

U.S. PATENT DOCUMENTS

| | | | | |
|---|---|---|---|---|
| 3,088,776 | | 5/1963 | Aller | 302/52 |
| 3,177,042 | | 4/1965 | Borger et al. | 302/58 |
| 3,252,431 | | 5/1966 | Phillips | 105/360 |
| 3,339,499 | | 9/1967 | Charles et al. | 105/248 |
| 3,343,888 | * | 9/1967 | Anderson et al. . | |
| 3,420,419 | | 1/1969 | Haslett, Jr. | 222/544 |
| 3,583,330 | * | 6/1971 | Freudman et al. | 105/239 |
| 3,583,331 | | 6/1971 | Mowatt-Larseen | 105/360 |
| 3,639,007 | | 2/1972 | Dare et al. | 302/52 |
| 3,708,209 | | 1/1973 | Dugge | 302/52 |
| 3,778,114 | | 12/1973 | Carney et al. | 302/52 |
| 3,837,497 | | 9/1974 | Smith | 210/349 |
| 3,929,261 | | 12/1975 | Solimar | 222/195 |
| 4,082,365 | | 4/1978 | Dugge et al. | 302/52 |
| 4,101,175 | | 7/1978 | Kull | 302/53 |
| 4,106,749 | | 8/1978 | Behle | 351/144 |
| 4,151,935 | | 5/1979 | Dugge | 222/556 |
| 4,165,820 | | 8/1979 | Dugge et al. | 222/70 |
| 4,189,262 | | 2/1980 | Anderson | 406/136 |
| 4,194,450 | * | 3/1980 | Miller | 105/253 |
| 4,227,732 | * | 10/1980 | Kish . | |
| 4,254,714 | * | 3/1981 | Heap | 105/406.1 |
| 4,280,706 | | 7/1981 | Vorwerk | 277/12 |
| 4,286,524 | | 9/1981 | Jantzen | 105/248 |
| 4,352,331 | | 10/1982 | Anderson et al. | 105/248 |
| 4,353,560 | | 10/1982 | Tohill | 277/236 |
| 4,353,668 | | 10/1982 | Anderson | 406/90 |
| 4,360,295 | | 11/1982 | Anderson | 406/76 |
| 4,361,096 | * | 11/1982 | Funk | 105/248 |
| 4,362,111 | | 12/1982 | Stark et al. | 105/247 |
| 4,384,730 | | 5/1983 | Diehl | 277/236 |
| 4,428,585 | | 1/1984 | Dugge | 277/12 |
| 4,444,123 | | 4/1984 | Smith et al. | 105/377 |
| 4,455,947 | | 6/1984 | Reeve et al. | 105/377 |
| 4,466,558 | | 8/1984 | Dugge et al. | 222/195 |
| 4,484,528 | | 11/1984 | Anderson et al. | 105/248 |
| 4,484,852 | | 11/1984 | Anderson | 414/525 |
| 4,498,400 | | 2/1985 | Vorwerk et al. | 105/248 |
| 4,568,224 | | 2/1986 | Dugge et al. | 406/90 |
| 4,594,948 | * | 6/1986 | Smith et al. | 105/359 |
| 4,598,646 | | 7/1986 | Dugge et al. | 105/248 |
| 4,617,868 | | 10/1986 | Wahlstrom et al. | 105/282 |
| 4,644,871 | | 2/1987 | Arrey et al. | 105/4 |
| 4,662,543 | | 5/1987 | Solimar | 222/195 |
| 4,677,917 | | 7/1987 | Dugge et al. | 105/248 |
| 4,718,795 | | 1/1988 | Dugge | 406/30 |
| 4,768,684 | | 9/1988 | Dugge | 222/542 |
| 4,846,377 | | 7/1989 | Fix et al. | 222/195 |
| 4,867,073 | | 9/1989 | Dugge | 105/358 |
| 4,880,148 | * | 11/1989 | Schmidt | 222/195 |
| 4,884,511 | * | 12/1989 | Hallam et al. | 105/247 |
| 4,884,723 | | 12/1989 | Dugge | 222/542 |
| 4,898,101 | | 2/1990 | Harter | 105/247 |
| 4,902,215 | | 2/1990 | Seemann, III | 425/406 |
| 5,000,358 | | 3/1991 | Dugge | 222/502 |
| 5,052,906 | | 10/1991 | Seemann | 425/112 |
| 5,073,259 | * | 12/1991 | Solimar | 210/232 |
| 5,139,175 | * | 8/1992 | Krysel et al. . | |
| 5,236,287 | | 8/1993 | Dugge et al. | 406/145 |
| 5,238,333 | | 8/1993 | Dugge et al. | 406/145 |
| 5,248,227 | * | 9/1993 | Hidock et al. | 406/41 |
| 5,259,322 | * | 11/1993 | Dominguez et al. | 105/4.1 |
| 5,263,421 | * | 11/1993 | Lichty et al. | 105/248 |
| 5,316,462 | | 5/1994 | Seeman | 425/112 |
| 5,355,809 | | 10/1994 | Dugge | 105/424 |
| 5,400,718 | * | 3/1995 | Theurer et al. . | |
| 5,433,559 | * | 7/1995 | Sande | 406/145 |
| 5,657,700 | * | 8/1997 | Bounds | 105/311.1 |

OTHER PUBLICATIONS

Trademark Power Flo, Reg. No. 1,543,426, registered Jun. 13, 1989.

U.S. patent application Ser. No. 09/295,237 by Vande Sande, et al. entitled "Pressure Discharge Railway Hopper Cars" (previously U.S. Provisional Appl. Serial No. 60,082,702 filed Apr. 22, 1998) (Attorney Docket 091078.0656). Filed Apr. 19, 1999.

U.S. patent application Ser. No. 09/528,208 by Vande Sande entitled "Aerator Pad Assembly for Railway Hopper Cars" (previously U.S. Provisional Appl. Serial No. 60,125,371 filed Mar. 18, 1999) (Attorney Docket 091078.0798), filed Mar. 17, 2000.

* cited by examiner

FIG. 8
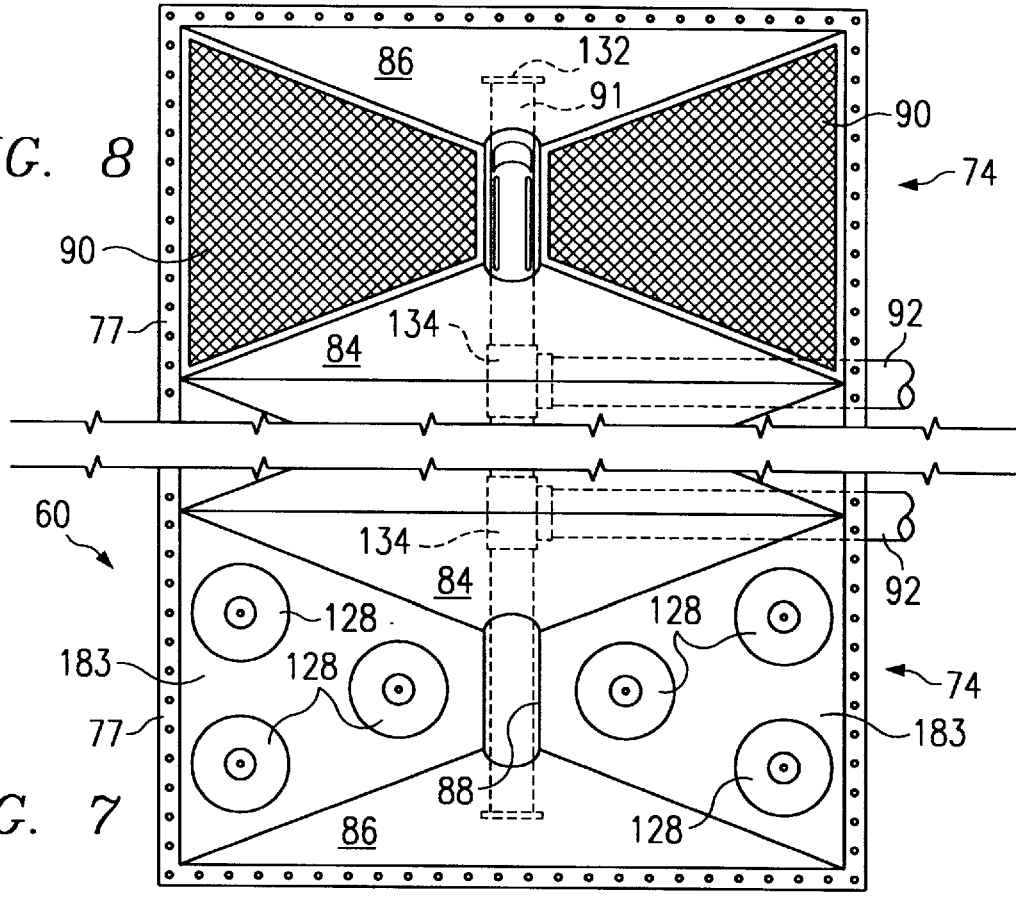
FIG. 7
FIG. 9
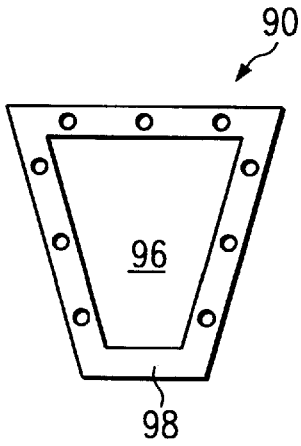

PRESSURE DISCHARGE RAILWAY HOPPER CAR

RELATED APPLICATIONS

This application claims the benefit of U.S. Provisional Patent Application Ser. No. 60/082,701, filed Apr. 22, 1998 and U.S. Provisional Application Ser. No. 60/082,702 filed Apr. 22, 1998.

This application is related to U.S. patent application Ser. No. 09/295,237 entitled Large Capacity Car Body for Pressure Discharge Railway Hopper Cars, filed Apr. 19, 1999, now U.S. Pat. No. 6,237,505; and related to U.S. patent application Ser. No. 09/528,208 entitled Aerator Pad Assembly for Railway Hopper Cars, filed Mar. 17, 2000.

TECHNICAL FIELD OF THE INVENTION

The present invention relates generally to railway hopper cars and, more particularly, to hoppers and product discharge apparatus associated with pressure discharge railway hopper cars.

BACKGROUND OF THE INVENTION

Closed railway hopper cars with pneumatic systems for unloading are often used for the transportation of powdered and granular products. For cars with positive pressure pneumatic systems, air is supplied from an external source to pressurize the interior of the car body and simultaneously fluidize the dry, bulk product carried within the car to enable it to be conveyed in a fluidized state in an air flow through product transfer conduits from the car. Air pressure within the hopper car during the unloading procedure may be maintained at approximately fifteen psi gage. The pneumatic discharge or unloading system associated with a pressure discharge railway hopper car may include an air supply conduit for directing a portion of the air supplied to the hopper car into the discharge line leading from the car to the destination of the product being discharged. The air pressure in the discharge line may be maintained at two or three psi below the pressure within the hopper car.

Trinity Industries, Inc., the assignee of the present invention, manufactures and sells Power Flo® pressure discharge railway cars with pneumatic unloading systems. An example of aeration equipment and a pneumatic discharge system for removing dry, bulk material from hopper style containers is described and shown in U.S. Pat. No. 3,929,261 entitled Aeration Device and Method for Assisting Discharge of Material from Containers. Reference may also be made to U.S. Pat. No. 5,433,559 entitled Pressurized Hopper Car.

Flours, starch and similar powdery food products are examples of dry, bulk material suited for loading, transportation and discharge with an enclosed hopper car having a positive pressure pneumatic unloading system. Any dry powder, granular, or pellet-form commodity may, usually to advantage, be transported in such hopper cars. An enclosed hopper car and the pneumatic discharge apparatus protect the contents of the car and minimizes product losses during the loading, transportation, and the discharge process. Also, pneumatic transport is often the most cost effective, efficient method of moving large quantities of dry, bulk product.

Pressure discharge hopper cars may have a single product outlet leading from each hopper located near the center of the car and opens to a hopper discharge conduit located therebelow. Discharge conduits connected to each hopper outlet communicate with the hopper outlet and are typically connected to a main product transfer conduit extending along the side of the car. Providing piping immediately below each hopper outlet within appropriate American Association of Railroads (AAR) plate may limit the height above the track of the bottom of each hopper.

SUMMARY OF THE INVENTION

In accordance with teachings of the present invention, disadvantages and problems associated with the fabrication, assembly and use of pressure discharge railway hopper cars have been substantially reduced or eliminated.

One embodiment of the present invention provides a pressure discharge hopper car having an increased capacity, a lower center of gravity, and lower air resistance than previously known hopper cars of comparable size and type. One aspect is to reduce the costs of designing, producing parts for, and assembling pressure discharge railway cars. Another aspect is to provide a pressure discharge railway car that can readily handle a wide variety of dry materials and that can be unloaded more quickly and with fewer operating steps than previously known cars of comparable size.

A particular embodiment of the present invention provides a pressure discharge railway hopper car that includes a car body having a plurality of hoppers arranged in adjacent relation longitudinally of the car body. Each hopper may have a discharge opening at its bottom end with an aerator tub assembly attached to the bottom end. The aerator tub assembly preferably includes a top opening extending generally coextensive with the discharge opening of the hopper. Each aerator tub assembly may be symmetrical with respect to the longitudinal centerline of the car with two aerator units respectively disposed opposite sides of the centerline. Downwardly convergent inclined walls of each section define two outlet openings at substantially the lowermost portion thereof. The respective aerator units divide the flow of product from each hopper when the car is being unloaded approximately in half, one-half of the product on one side of the longitudinal centerline of the car being discharged through the outlet of the aerator unit on that side of the centerline and the remaining half being discharged through the outlet of the aerator unit on the other side of the centerline.

Technical advantages of the present invention include dividing the discharge paths of each hopper approximately in half along the longitudinal centerline such that the upper ends of the inwardly sloping side walls (hopper side skirts) of each hopper can be at a relatively low height above the bottom of the AAR Plate and laterally close to the sides of the AAR plate.

Another technical advantage includes the width between the hopper side skirts which can be relatively large. The sloping side walls of each aerator unit of each aerator tub assembly, each of which side walls may have a slope above a preselected valve to maintain gravity flow of all products for which the car is designed, which may eliminate the need for any aeration devices disposed laterally of the respective aerator units. The lateral walls adjacent the centerline, which are preferably joined at an apex, divert product from the center portion of the car to the outlets of the aerator units. Yet another technical advantage includes the increase in size of the lower portion of the car body, thus increasing the capacity and lowering the center of gravity of the resulting car body, as compared to comparable cars with a single center outlet from each hopper. The total height of each hopper and its associated aerator tub assembly is kept relatively low—the side sheets of the car body may be taller and farther apart at the bottom. The side skirts of the hoppers may be planar, which simplifies making piece-parts for the car body and assembling the resulting hopper car.

Still another technical advantage includes the product discharge conduit which leads substantially horizontally and laterally from the outlet of each aerator unit toward the centerline of the car body. Each product discharge conduit may be a length of pipe having an opening in its wall. The lower ends of the side walls and end walls of each aerator unit of each aerator tub assembly are joined at the perimeter of the outlet to the walls of the pipe around the perimeter of the opening in the pipe wall. This arrangement requires only about half of the pipe diameter between the bottom of the tub and the bottom of the applicable AAR Plate. A full pipe diameter of the discharge pipe may open laterally. The half pipe immediately below the aerator unit presents a favorable shape for completely emptying the car.

In conjunction with the outlet conduit of each aerator unit, a generally L-shaped discharge pipe may be associated with each aerator tub assembly. Each L-shaped discharge pipe may have a longitudinal leg that is connected to the product discharge conduits of the two aerator units of the associated aerator tub assembly located between the aerator units and a lateral leg that extends transversely to the centerline to an outlet end laterally outwardly of the aerator tub assembly. The L-shaped pipes optimize use of the space between the aerator units of each aerator tub and between adjacent aerator tubs and conserve space outboard of the aerator units. In a particular embodiment a main discharge pipe may extend longitudinally along a side of the rail car laterally of the aerator tub assemblies. The L-shaped discharge pipe associated with each of the aerator tub assemblies are preferably connected to the main discharge pipe.

Each section of each aerator tub assembly includes a pair of opposite side walls and a pair of opposite end walls. As mentioned above, the side walls of each section nearer the longitudinal centerline are joined at their upper ends along an apex. It may be desirable that each of the side walls of each aerator unit have a slope of not less than approximately 55° for maximum versatility of use of the car for transporting dry powder, granular, or pellet-form commodity that tend to hang up on the walls. Each of the end walls of each aerator unit may be an aeration panel.

In one particular embodiment of the present invention a first pair of adjacent hoppers having a first space between their aeration tub assemblies and a second pair of adjacent hoppers having a second space between their aeration tub assemblies are provided. The longitudinal legs of the L-shaped discharge pipes associated with the hoppers of the first pair lead to the first space and the lateral legs of the L-shaped discharge pipes associated with the hoppers of the first pair extend laterally along the first space in side-by-side relation. The longitudinal legs of the L-shaped discharge pipes associated with the hoppers of the second pair lead to the second space and the lateral legs of the L-shaped discharge pipes associated with the hoppers of the second pair extend laterally along the second space in side-by-side relation. Pairing of the hoppers and using the space between the hoppers of each pair to lead the L-shaped discharge pipes laterally makes good use of the available space, which is minimized due to the low height of the aeration tub assembles. In conjunction with this configuration of the branch piping, there is a another space between the aeration tub assemblies of the hoppers of the first and second pairs that are closer to each other. The main product transfer conduit has an outlet coupling located in this space. This space also allows for discharge on either side of the car.

Economies in design, manufacture or purchase of piece-parts, and assembly of the car are made possible by arranging the hoppers, aeration tub assemblies, discharge pipes and L-shaped discharge pipes substantially symmetrically with respect to the transverse centerline of the car.

BRIEF DESCRIPTION OF THE DRAWINGS

For a more complete understanding of the present invention, and the advantages thereof, reference may be made to the following written description of an exemplary embodiment, taken in conjunction with the accompanying drawings, in which:

FIG. 7 is a schematic drawing, with portions broken away, showing an alternative configuration of an aerator unit, suitable for use within teachings of the present invention;

FIG. 8 is a schematic drawing, with portions broken away, showing another alternative configuration of an aerator unit, suitable for use within teachings of the present invention;

FIG. 9 is a schematic drawing showing portions of an aerator pad assembly suitable for use within teachings of the present invention;

DESCRIPTION OF THE EMBODIMENTS

Preferred embodiments of the present invention and its advantages are best understood by referring to FIGS. 1–16 of the drawings, like numerals being used for like and corresponding parts of the various Figures.

Figure 1:
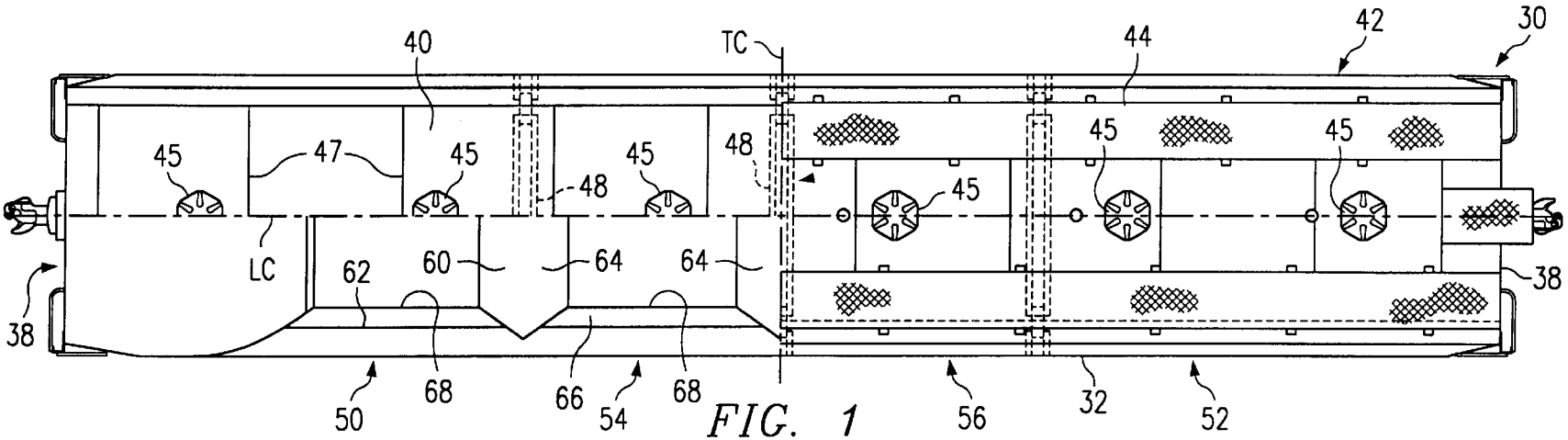
FIG. 1 is a schematic drawing, with portions broken away, showing a top view of a railway hopper car incorporating teachings of the present invention.
Figure 2:
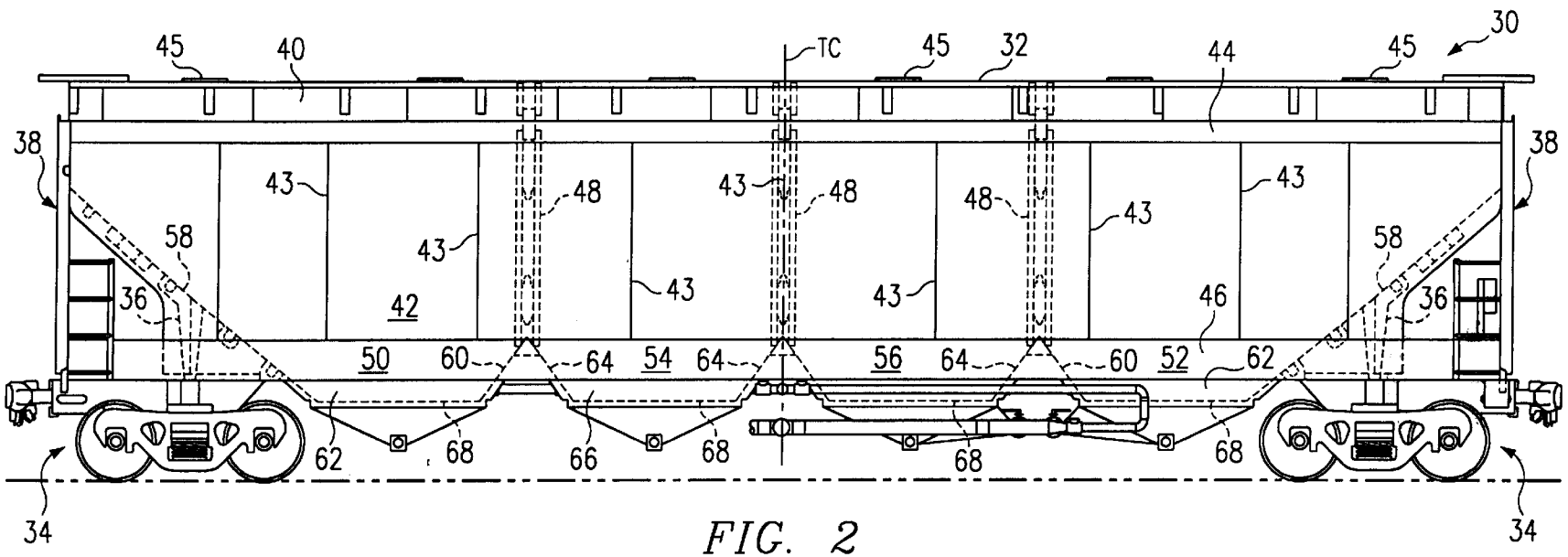
FIG. 2 is a schematic drawing, with portions broken away, showing a side view of the railway hopper car of FIG. 1.
Figure 3:
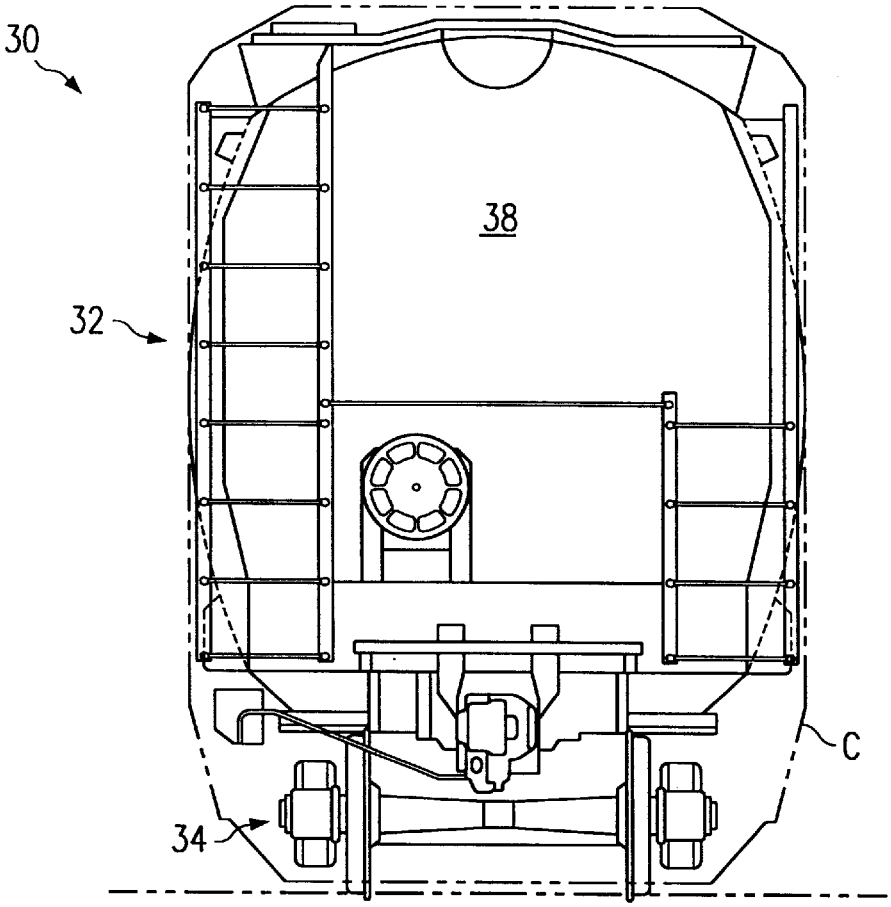
FIG. 3 is a schematic drawing, with portions broken away, showing an end view of the railway hopper car of FIG. 1.

A railway hopper car generally indicated by the reference numeral 30, is illustrated in FIGS. 1–3. Car 30 is configured and dimensioned to conform to AAR Plate "C", the outlines of which appear in FIG. 3 in phantom lines and labeled "C". Car 30 has a body 32 which is supported at each end on trucks 34 by bolsters 36 incorporated into end structures 38 of body 32. Body 32 is generally symmetrical about transverse centerline TC and longitudinal centerline LC of car 30. A top sheet 40 and side sheets 42 form a partially enclosed container. Side sheets 42 include curved plates butt-welded at junctures 43. Similarly, top sheet 40 may include curved plates butt-welded at junctures 47.

Car 30 is typically loaded with products via covered hatches 45 installed in top sheet 40. Channel-shaped top cords 44 and bottom cords 46 extend along each upper and lower edges of body 32. Crossridge frames 48 support top sheet 40 and side sheet 42. Body 32 may, but need not be, constructed in the manner described and shown in U.S. patent application Ser. No. 09,295,237, entitled Large Capacity Car Body for Pressure Discharge Railway Hopper Cars.

Railway hopper car 30 has four hoppers 50, 52, 54 and 56. Front and rear hoppers 50 and 52 are formed in part by end slope plates 58 of car 30, end structures 38, transverse slope plates 60 and hopper side skirts 62. Center hoppers 54 and 56, which adjoin each other at transverse centerline TC, are formed in part by transverse slope plates 64 and side skirts 66. Each hopper 50, 52, 54, and 56 has a rectangular discharge opening 68 at its lower end, discharge openings 68 being of similar size and shape and each being defined by a perimeter frame 70 (FIG. 4).

Figure 4:
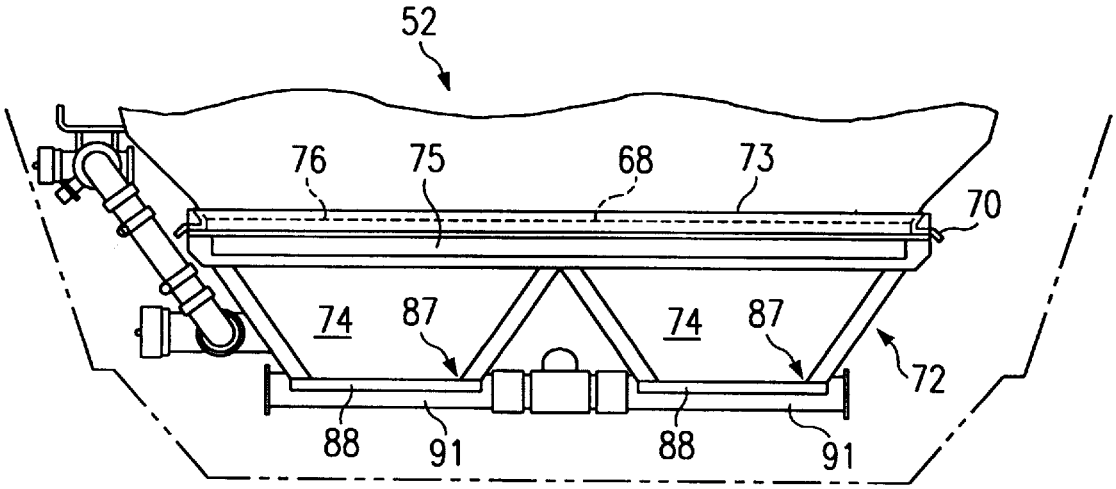
FIG. 4 is a schematic drawing, with portions broken away, showing a partial end view of an aerator tub assembly suitable for use with the railway hopper car of FIG. 1.

Referring to FIGS. 2 and 4, a respective aerator tub assembly 72 may be bolted to frame 70 of each hopper 50, 52, 54 and 56. Each aerator tub assembly 72 includes a respective opening 73. Opening 73 is defined in part by a peripheral frame 76, coextensive with discharge opening 68 of the respective hopper. Frame 76 may be fabricated from angle sections, the legs of which are preferably attached to frame 70. In another embodiment, aerator tub assembly 72 may be welded to frames 70. Each aerator tub assembly 72 is generally symmetrical with respect to longitudinal centerline LC. Each aerator tub assembly 72 includes a plenum 75 and two aerator units 74 associated therewith. Aerator units 74 include outlet openings 87 which communicate with discharge conduits 91 through openings 88. Aerator tub assemblies 72 may be provided in various sizes and configurations in accordance with teachings of the present invention. In the illustrated embodiment, each aerator tub assembly 72 is identical.

Figure 5:
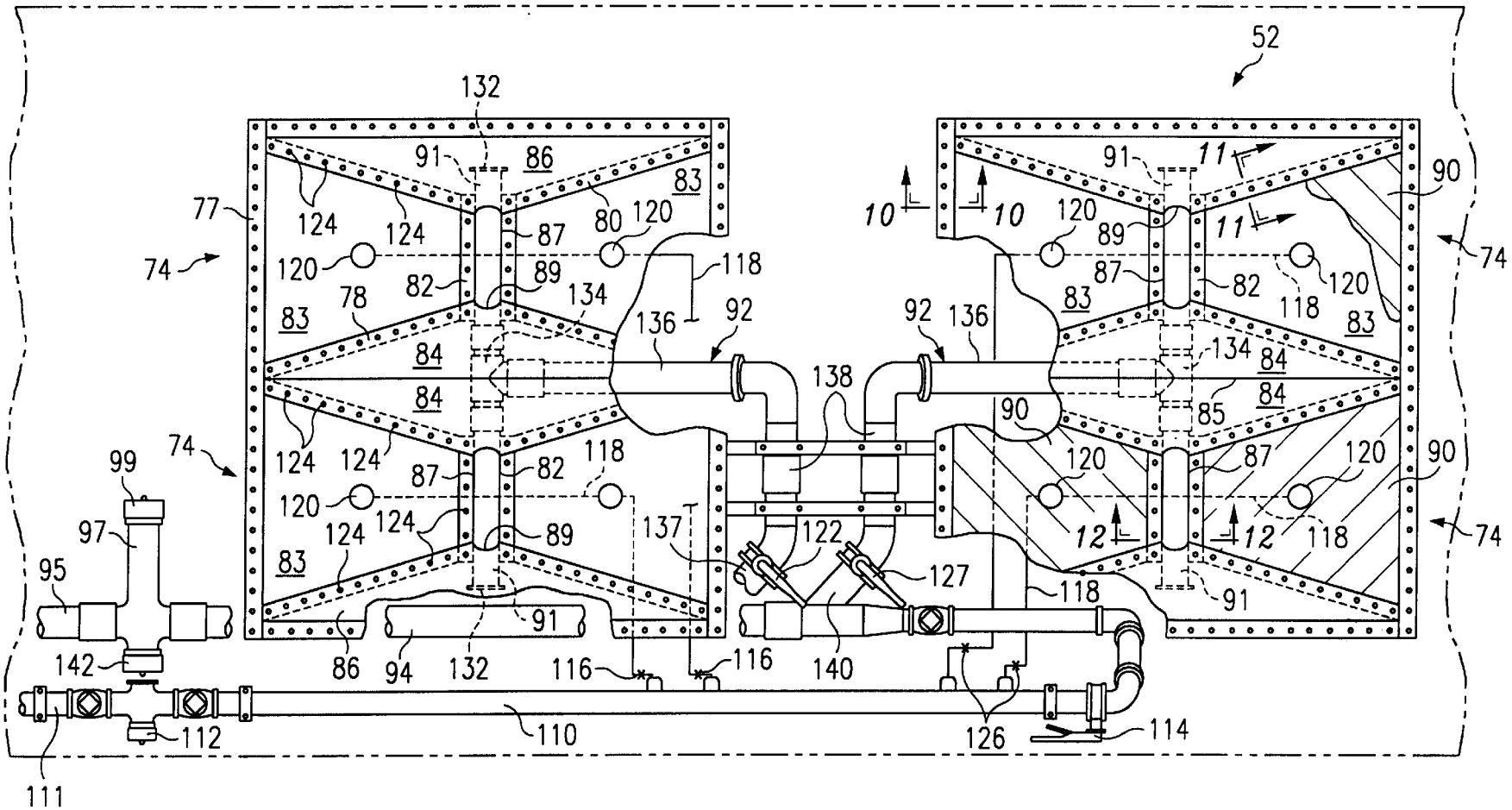
FIG. 5 is a schematic drawing, with portions broken away, showing a cross sectional top view of components of the railway hopper car of FIG. 1.
Figure 6:
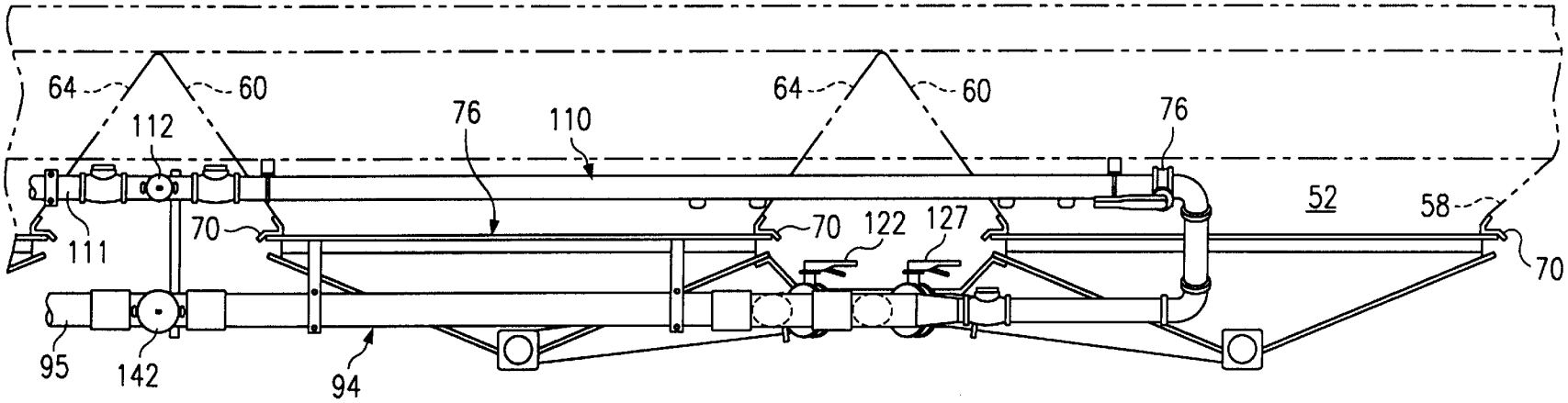
FIG. 6 is a schematic drawing, with portions broken away, showing a side elevational view of assemblies and piping of FIG. 4.
Figure 10:
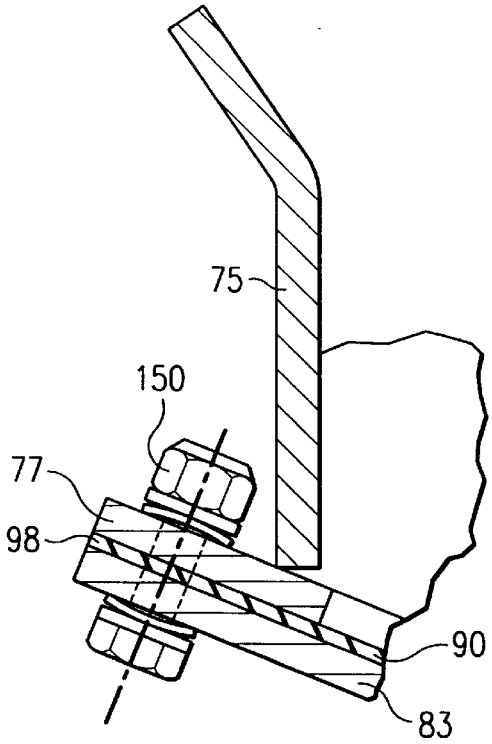
FIG. 10 is a schematic drawing showing a cross-section taken along line 10—10 of FIG. 5.
Figure 11:
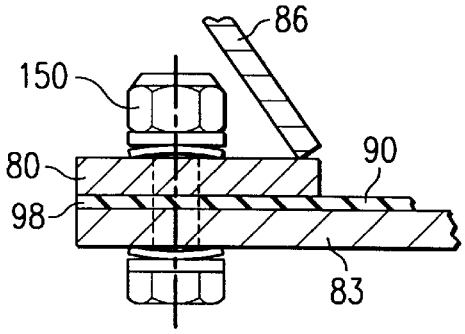
FIG. 11 is a schematic drawing showing a cross-section taken along line 11—11 of FIG. 5.
Figure 12:
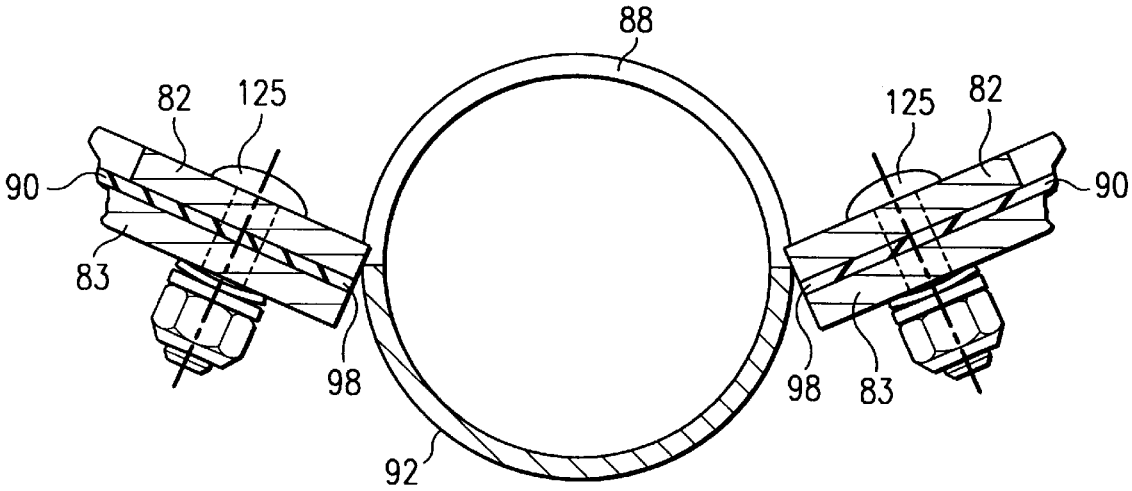
FIG. 12 is a schematic drawing showing a cross-section taken along line 12—12 of FIG. 5.
Figure 13:
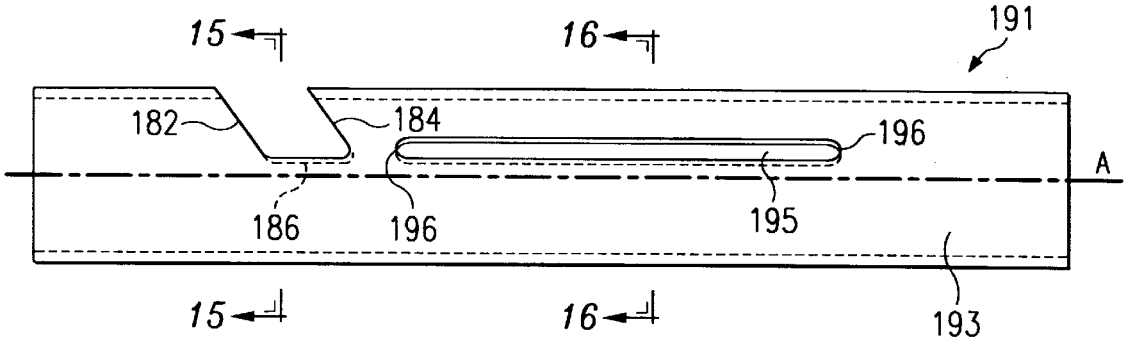
FIG. 13 is a schematic drawing showing a side view of a discharge conduit suitable for use within teachings of the present invention.
Figure 14:
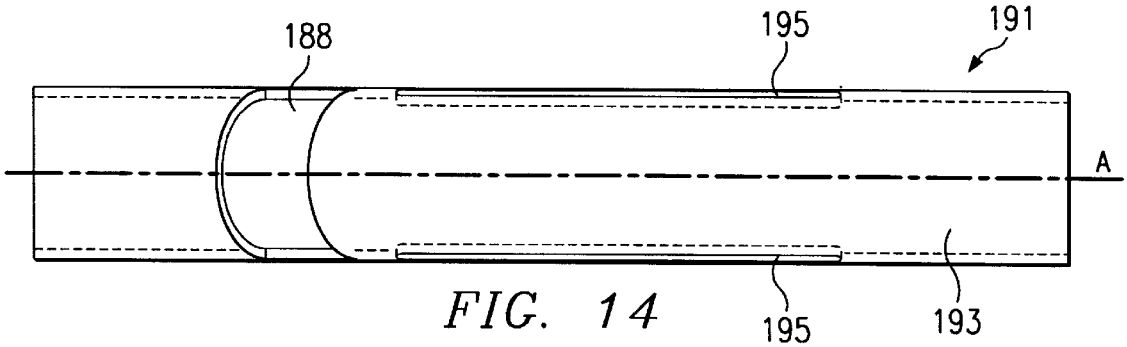
FIG. 14 is a schematic drawing showing a top view of the discharge conduit of FIG. 13.
Figure 15:
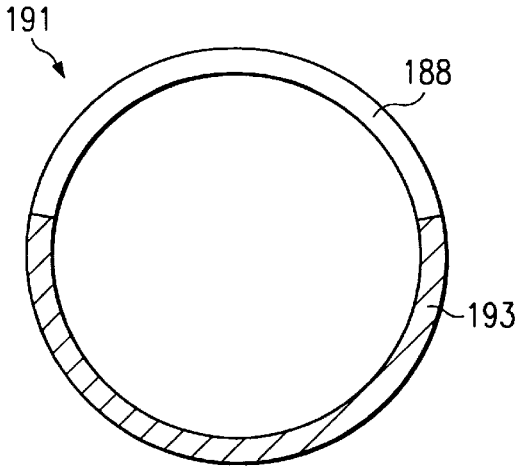
FIG. 15 is a schematic drawing showing a cross-section taken along line 15—15 of FIG. 13.
Figure 16:
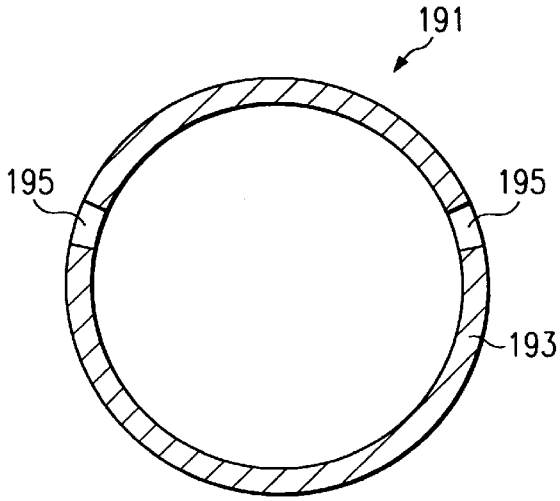
FIG. 16 is a schematic drawing showing a cross-section taken along line 16—16 of FIG. 13.

A cross-sectional top view of aerator tub assemblies 72 and their associated piping and components is illustrated in FIG. 5. Aerator units 74 are defined in part by downwardly convergent inclined walls including inner and outer side slope panels 84 and 86, respectively, and end walls, or aeration panels 83 which define an outlet opening 87 at substantially a lower most portion of aerator units 74. Aeration panels 83 are coupled with side support angles 78 and 80 associated with side slope panels 84 and 86, respectively, with a number of mechanical fasteners 124. Aeration panels 83 are also coupled to support angle 77 of panel 75 with additional mechanical fasteners 124. Side slope panels 86 slope downwardly from support angle 77 toward outlet opening 87. Inner side slope panels 84 are joined at their upper ends, proximate longitudinal centerline LC, along apex 85 and slope downwardly from apex 85, toward outlet opening 87. Elliptical cut outs 89 within side slope panels 84 and 86 further define outlet opening 87. Transverse support angles 82 are attached to branch discharge piping 92 and secured to aeration panel 83 with mechanical fasteners 125. Mechanical fasteners 125 are preferably a "roundhead" type to avoid obstruction of outlet opening 87 of discharge piping 92. The lower portion of inner and out side slope panels 84 and 86, and aeration panel 83 are joined at the perimeter of outlet opening 87 to the walls of discharge conduit 91 around the perimeter of opening 88. This arrangement requires approximately one half of the diameter of discharge conduit 91 to occupy the space between aerator units 74 and the bottom of the AAR plate "C." Accordingly, the overall volume of railway hopper car 30 may be increased in accordance with teachings of the present invention while remaining within AAR plate "C" specifications.

Air inlets 120 are provided with an aeration panels 83 to facilitate the introduction of pressurized air or gas into car 30. In the illustrated embodiment, one air inlet is provided within each aeration panel 83. As discussed in more detail with respect to FIGS. 7 and 8, one or more aerator cone assemblies 128 may also be incorporated into aeration panel 83, as desired, to enhance the performance of the system during unloading.

In the illustrated embodiment, side slope panels 84 and 86 are oriented at approximately 55° with respect to a horizontal axis (not expressly shown). The slope of side slope panels 84 and 86, and the elliptical cut outs 89 disposed therein allow granular and powered products to slide down panels 84 and 86 under the force of gravity, to outlet opening 87 located at the bottom of each aerator unit 74. Since car 30 is symmetrical about transverse centerline TC, and aerator tub assemblies 72 function similarly, the operation of hoppers 52 and 56 will be described in detail, for illustrative purposes.

Referring now to FIGS. 5–8, outlet opening 87 at the bottom of each aerator unit 74 communicates with discharge conduits 91. In the illustrated embodiment, each discharge conduit 91 is a length of pipe with an opening 88 in its wall that corresponds to and communicates with outlet opening 87, and extends over approximately one half of the circumference of the pipe. Openings 88 and discharge conduits 91 provide a path of fluid communication between each aerator unit and an L-shaped discharge pipe 92 associated with each aerator tub assembly 72. Each L-shaped discharge pipe has a longitudinal leg 136 connected to the discharge conduits 91 of each aerator tub assembly 72 and a lateral leg 138 extending transversely from the longitudinal centerline LC to an outlet end 137 laterally outward from the aerator tub assembly 72. Outlet openings 88 communicate with discharge conduits 91 and branch discharge piping 92 to accommodate unloading. Branch discharge piping 92 is coupled with main discharge piping 94, which carries the contents of hopper car 30 downstream to product discharge piping 97. Couplings 99 and 142 are sealed during transport and later, one or both is connected to additional piping (not expressly shown) in order to transport the product to a collection facility. Elliptical cutouts 87 cooperate with an approximately match the outer diameter of discharge conduit 91.

Discharge conduits 91 are welded to transverse support angles 82 and/or along elliptical cutouts 89 within side slope panels 84 and 86. Accordingly, the entire inside diameter of discharge conduit 91 provides a laterally facing outlet from outlet opening 87 of each aerator unit 74. The out board end of each discharge conduit 91 is sealed by cap 132, which can be removed in order to clean the interior of car 30 and all associated piping. The inboard end of each discharge conduit 91 communicate with L-shaped discharge piping 92 through a "T" type connection 134. L-shaped discharge piping 92 includes a longitudinal leg 136 which slopes slightly upwardly from T-type connection 134 along the longitudinal centerline of LC of car 30, to a lateral leg 138 which leads laterally outwardly to a 45° elbow 140. Main discharge piping 94 extends longitudinally along a side of the railway hopper car 30 laterally of the aerator tub assemblies 72 and communicates with the L-shaped discharge pipe 92 via 45° elbow 140.

Aerator assemblies 52 and 56 and the associated discharge piping 92 associated with each are paired together, in that the lateral leg portions 138 run along side each other in the space between hoppers 52 and 56. Since car 30 is symmetrical about transverse centerline TC, a similar arrangement of piping occurs between hoppers 50 and 54. This configuration leaves space between hoppers 54 and 56 ideal for product discharge piping 97, which is configured to accommodate product unloading from either side of car 30. Accordingly, two pipe couplings 99 and 142 are provided facing laterally in opposing directions, within product discharge piping 97.

In order for the unloading of car 30 to operate efficiently, the interior components of railway hopper car 30 must be properly sealed, including the associated discharge piping and valves. Referring to FIGS. 5, 7–12, aerator pad assemblies 90 provide a generally fluid tight seal between components of aerator tub assemblies 72, and facilitate the introduction of air into hopper car 30 in a clean and efficient manner. Aerator pad assemblies 90 may be installed up on each aeration panel 83 to seal joints between respective components, and to allow the flow of fluid through aerator pad assembly 90, without allowing the contents of car 30 to become lodged within air inlet 120.

Aerator pad assemblies 90 occupy the area between aeration panel 83 and respective support angle 78, 80, 77 and 82. A gasket 98 associated with aerator pad assembly 90 forms a fluid type seal between aeration panel 83 and support angles 77, 78, 80 and 82. Aerator pad assembly 90 is held in place in part by fasteners 125 and 150, and partially due to the compression between aerator pad assembly 90 and support angles 77, 78, 80, and 82. Aerator pad assembly 90 also includes an aeration fabric pad 96 which is preferably formed from material or fabric which will allow pressurized fluid to pass therethrough, but block solid materials, including the product within railway hopper car 30. Aeration fabric pad 96 covers the interior portion of aerator pad assembly 90. Aeration fabric pad 96 may be formed from fabric specifically selected with a woven density appropriate to prevent any granule or powdered product which may be carried in hopper car 30 from passing therethrough. Other materials and fabrics are suitable for use in forming aeration fabric pad 96, provided the specific fluid contained within supply lines 118 may pass through, and the product within car 30 will not. An aerator pad assembly suitable for use within teachings of the present invention is described and shown in U.S. patent application Ser. No. 09/528,208 entitled Aerator Pad Assembly for Railway Hopper Cars.

Material used to form gasket 98 is preferably selected to allow suitable compression to form an airtight seal between metal components of aerator tub assembly 72 at a pressure in excess of 15 pounds per square inch. In one embodiment, gasket 98 may be formed from a white, FDA approved food-grade polymer with a durometer of approximately 50–70. Other suitable compressible materials are available to form gasket 98. Fastener openings 130 are provided to accommodate fasteners 124, 125, or 150.

Referring to FIG. 7, one or more aerator cone assemblies 128 may be provided within aeration panels 83 to distribute the air flow through air inlets 120 more effectively and promote fluidization of product within hopper car 30. Flow cones as manufactured by Sure Seal and Solimar are suitable for use within teachings of the present invention. Additional information regarding Solimar's Flowcone is available in U.S. Pat. No. 4,662,543. It will be recognized by those skilled in the art that the size, number, shape and configuration of air inlets and/or aerator cone assemblies associated with aeration panel 83 may be significantly modified within teachings of the present invention.

Aerator cone assembly 128 is installed upon aeration panel 183 and acts as a fluidizing medium, through which air or gas may be introduced into aerator unit 74. Aerator cone assembly 128 may be used along upon aeration panel 183, or alternatively, multiple aerator cone assemblies 128 maybe installed upon one or more aeration panels 183. Aerator cone assemblies 128 may also be used in combination with aerator pad assembly 90, on a given aeration panel 183. Aerator pad assembly 90 provides an improved fluidizing medium, particularly for applications where aeration panels 83 is installed on a shallow surface, or one with a reduced slope with respect to a horizontal axis. Aerator cone assembly 128 functions most efficiently at a slope of greater than approximately 35 degrees, with respect to the horizontal. By increasing the slope of aeration panel 183, the volume of the interior of railway hopper car 30 may be reduced, since minimum height and width requirements of railway hopper car 30 must be satisfied.

One advantage of aerator cone assembly 128 is the vibration it causes upon aeration panel 83 and within other components of railway hopper car 30, during operation. This operation helps promote unloading and material cleanout, because it helps powdered or granulated substances slide down the slope of aeration panel 83 toward outlet opening 88. Alternatively, aerator cone assembly 128 may be used in combination with aerator pad assembly 90, to maximize the advantages of each, simultaneously.

Another advantage of using aerator cone assembly 128 is an increase in strength of the overall system. In order to install one and one half inch air inlets 120 within aeration panel 83, an aluminum coupling must be welded to aeration panel 83 in order to install an elbow. The welding of the aluminum reduces its overall strength. Installation of aerator cone assembly 128 does not require welding and does not require this decrease in strength.

In order to increase the efficiency of unloading, discharge conduit 91 may be modified as illustrated in FIGS. 13–16. Discharge conduit 191 includes a length of pipe 193 with a semicircular opening 188 and a pair of elongated slots 190 disposed therein. Slots 190 may vary significantly in size, number, orientation and configuration. In the illustrated embodiment slots 190 extend approximately twelve inches parallel to the central axis A of discharge conduit 191. Slots 190 terminate at either end with a one quarter inch radius opening 176. Slots 190 are approximately one half inch wide along the circumference of pipe 193 in a direction perpendicular to central axis A.

Cutout 188 extends approximately one half of the circumference of pipe 193 and includes sidewalls 182 and 184 and lower end 186. The cross section of cutout 188 illustrated in FIG. 13 generally conforms to three sides of a parallelogram. Side walls 182 and 184 are generally parallel to one another and each slope downwardly towards slots 190. This configuration facilitates the movement of product from within aerator unit 74 to discharge conduit 91 quickly and efficiently. This also prevents blockage or build-up of product at the opening 188. The number, size, configuration and orientation of opening(s) 188 may also be significantly modified within teachings of the present invention.

As mentioned previously, car 30 may be loaded with a bulk product (not expressly shown) which is typically in a powdered or granular state. Once the final destination is reached, car 30 may be unloaded quickly and easily according to the following sequence. Compressed air or other suitable gas is provided to railway hopper car 30 through main air supply line 110 by connecting an air source at fitting 112. In one embodiment, a flex hose or flex connection may be accomplished at fitting 112 in order to introduce air into car 30. In order to unload hoppers 52 and 56, with control valve 114 in the closed position, air is introduced to main air supply line 110. When ball valves 116 are opened, air will charge branch air supply lines 118. Air will enter railway hopper car 30 through air inlets 120, and the pressure within railway hopper car 30 can be increased to a predetermined level, for example, 14⁷⁄₁₀ pounds per square inch. Once this is accomplished, butterfly valve 122 disposed within discharge piping 92, may be opened to allow product to flow through discharge piping 92 and into main discharge piping 94, for downstream collection.

To enhance the flow of product through discharge piping 92 and 94, control valve 114 may be opened during the discharge procedure to provide a supply of air downstream of the flow of product as hopper car 30 is being unloaded. Typically a pressure differential of 2 to 3 pounds per square inch is maintained between railway hopper car 30 and main discharge piping 94. This insures the flow of product will remain continuous during unloading. Control valve 114 may be preset and/or modulated to maintain this difference in pressure.

Hopper 52 may be unloaded in a similar manner, by sealing ball valves 116 and butterfly valve 122 and opening ball valves 126 and butterfly valve 127. Similarly, hoppers 50 and 54 may be unloaded using main air supply line 111 and main discharge piping 95.

Railway hopper car 30 is partially emptied, one aerator tub assembly at a time. Two or more cycles of sequential openings of each aerator tub assembly to discharge to the main discharge piping 94 may be required to completely empty the car 30.

Railway hopper car 30 includes other elements that are well-known and require no description or illustration, including one or more safety vents, each with a pressure relief valve or a rupturable disc as desired, in the top of the car to prevent over-pressurization. A stand pipe, blow down valve, pressure relief valves and one or more inspection and cleanout ports, which are not shown in the drawings, may also be provided as part of the car. The blow down valve is used to depressurize the car after the unloading process has been completed. Advantageously, the blow down valve is installed on a pipe at the top of the end wall at the "A" end of the car and has a mechanical operating linkage that can be operated by a worker on the ground.

Although the present invention and its advantages have been described in detail, it should be understood that various changes, substitutions and alterations can be made herein without departing from the spirit and scope of the invention as defined by the following claims.

What is claimed is:

1. A railway hopper car, comprising:

a car body having a plurality of hoppers, each hopper having a discharge opening at a lower end of the hopper;

an aerator tub assembly attached to the lower end of at least one hopper and having an opening substantially coextensive with the discharge opening of the hopper;

the aerator tub assembly further comprising a first aerator unit and a second aerator unit, each aerator unit having downwardly convergent inclined walls defining an outlet opening at substantially a lower most portion of each aerator unit;

a discharge conduit with an opening disposed therein to form a fluid communication path between each aerator unit;

a generally L-shaped discharge pipe associated with each aerator tub assembly; and each discharge pipe having a longitudinal leg connected to the discharge conduits of each aerator tub assembly and a lateral leg extending transversely from a longitudinal center line of the car body to an outlet end laterally outward from the aerator tub assembly.

2. The railway hopper car of claim 1, wherein the downwardly convergent inclined walls comprise opposing inner and outer side slope panels and a pair of opposing end walls, the inner side slope panels associated with the first aerator unit and the second aerator unit joined at their upper ends along an apex.

3. The railway hopper car of claim 2, wherein the inner and outer side slope panels have a slope of not less than approximately forty degrees with respect to a horizontal axis.

4. The railway hopper car of claim 2 wherein at least one of the end walls of each aerator unit is an aeration panel.

5. The railway hopper car of claim 4 wherein the at least one aeration panel further comprises an air inlet and further comprising an aerator pad assembly disposed between the at least one aeration panel and support angles associated with the aerator unit.

6. The railway hopper car of claim 5 further comprising at least one aerator cone assembly installed upon the at least one aeration panel.

7. The railway hopper car of claim 4 further comprising at least one aerator cone assembly installed upon the at least one aeration panel.

8. The railway hopper car of claim 1, further comprising the discharge conduit attached to lower ends of the inclined walls approximate a midpoint of a vertical axis through the discharge conduit.

9. The railway hopper car of claim 1 wherein the discharge conduit comprises at least one elongated slot adjacent the outlet opening of each aerator unit.

10. A railway hopper car comprising:

a car body having a plurality of hoppers, each hopper having a discharge opening at a lower end of the hopper;

an aerator tub assembly attached to the lower end of at least one hopper and having an opening substantially coextensive with the discharge opening of the hopper;

a first aerator unit and a second aerator unit associated with the aerator tub assembly each aerator unit having downwardly convergent inclined walls defining an outlet opening at substantially a lower most portion of each aerator unit;

a discharge conduit with an opening disposed therein to form a fluid communication path between each aerator unit and the discharge pipe associated with each aerator tub assembly, the discharge conduit comprising at least one elongated slot adjacent the outlet opening of each aerator unit;

the discharge pipe further comprising a generally L-shaped configuration with a longitudinal leg connected to the discharge conduits of each aerator tub assembly;

a lateral leg extending transversely from the longitudinal centerline to an outlet end laterally outward from the aerator tub assembly; and a main discharge pipe extending longitudinally along a side of the railway hopper car laterally of the aerator tub assemblies with the L-shaped discharge pipe associated with each of the aerator tub assemblies being connected to the main discharge pipe.

11. A railway hopper car comprising:

a car body having a plurality of hoppers, each hopper having a discharge opening at a lower end of the hopper;

an aerator tub assembly attached to the lower end of at least one hopper and having an opening substantially coextensive with the discharge opening of the hopper;

a first aerator unit and a second aerator unit associated with the aerator tub assembly, each aerator unit having downwardly convergent inclined walls defining an outlet opening at substantially a lower most portion of each aerator unit;

a discharge conduit with an opening disposed therein to form a fluid communication path between each aerator unit and the discharge pipe associated with each aerator tub assembly, the discharge conduit comprising at least one elongated slot adjacent the outlet opening of each aerator unit;

a first pair of adjacent hoppers having a first space between their aeration tub assemblies and a second pair of adjacent hoppers having a second space between their aeration tub assemblies;

the longitudinal legs of the L-shaped discharge pipe associated with the hoppers of the first pair lead to the first space and the lateral legs of the L-shaped discharge pipe associated with the hoppers of the first pair extend laterally along the first space in side-by-side relation; and the longitudinal legs of the L-shaped discharge pipe associated with the hoppers of the second pair lead to the second space and the lateral legs of the L-shaped discharge pipe associated with the hoppers of the second pair extend laterally along the second space in side-by-side relation.

12. The railway hopper car of claim 11 further comprising a third space between the first and second pair of adjacent hoppers, and wherein a main product transfer conduit has an outlet coupling located in the third space, the main product transfer conduit coupled to the outlet ends of the lateral leas of the discharge pipes associated with the first and second pairs of hoppers.

13. The railway hopper car of claim 1 wherein the railway car further comprises a transverse centerline and the hoppers, aerator tub assemblies and discharge openings arranged substantially symmetrically with respect to the transverse centerline.

14. A pressure discharge railway hopper car, comprising:

a car body having a longitudinal centerline and a plurality of hoppers arranged in adjacent relation longitudinally of the car body, each hopper having a discharge opening at a bottom end of the hopper;

an aerator tub assembly attached to the bottom end of each hopper and having an opening coextensive with the discharge opening of the hopper, each aerator tub assembly having two aerator units having downwardly convergent inclined walls defining two outlet openings, one on each side laterally of the longitudinal centerline, at substantially a lowermost portion of the aerator unit;

a product discharge conduit leading substantially horizontally and laterally from the outlet of each discharge aerator unit toward the centerline of the car body;

a generally L-shaped branch discharge pipe associated with each aerator tub assembly, each discharge pipe having a longitudinal leg connected to the product discharge conduits of the two aerator units and a lateral leg extending transversely to the longitudinal centerline to an outlet end laterally outwardly of the aerator tub assembly; and a main discharge pipe extending longitudinally along a side of the rail car laterally of the aerator tub assemblies, the discharge conduits associated with all of the aerator tub assemblies being connected to the main discharge pipe.

15. The railway hopper car of claim 14 wherein each aerator tub assembly is symmetrical with respect to the longitudinal centerline.

16. The railway hopper car of claim 14 wherein the outlet opening of each aerator unit is rectangular in plan and elongated in a direction transverse to the longitudinal centerline.

17. The railway hopper car of claim 14 wherein each product discharge conduit is a length of pipe having an opening in its wall, and the lower ends of the inclined walls of each aerator unit are joined at the perimeter of the outlet opening to the walls of the pipe around the perimeter of the opening in the pipe wall.

18. The railway hopper car of claim 14 further comprising a conveying air supply pipe extending longitudinally along the railway hopper car generally coextensively with, generally above and on the same side of the railway car as the main discharge pipe, the conveying air supply pipe having a coupling adapted to be connected to a source of air under above-atmospheric pressure and being connected to opposite ends of the main product transfer conduit.

19. The railway hopper car of claim 14 wherein the product discharge conduit includes an opening covering approximately one half of the pipe circumference and at least one elongated slot, the opening and the elongated slot positioned adjacent and cooperating with the outlet openings to provide a path of fluid communication between the aerator units and the discharge conduit.

20. An aerator tub assembly for use with a pressure discharge railway hopper car having a longitudinal centerline and a plurality of hoppers, comprising:

a plurality of aerator means for aerating the aerating means having downwardly convergent inclined walls defining associated outlet openings at substantially a lowermost portion of the aerator unit;

at least one outlet opening on either side of the longitudinal centerline;

a product discharge conduit leading substantially horizontally and laterally from the outlet of each aerator unit toward the longitudinal centerline of the car body;

a generally L-shaped branch discharge pipe associated with each aerator tub assembly; and each discharge pipe having a longitudinal leg connected to the product discharge conduits of the two aerator units and a lateral leg extending transversely to the longitudinal centerline to an outlet end laterally outwardly of the aerator tub assembly.

* * * * *